US010309430B2

(12) United States Patent
Hull

(10) Patent No.: US 10,309,430 B2
(45) Date of Patent: Jun. 4, 2019

(54) PNEUMATIC ACTUATION ASSEMBLY

(71) Applicant: Confluent Surgical, Inc., Bedford, MA (US)

(72) Inventor: Les Hull, Attleboro, MA (US)

(73) Assignee: Confluent Surgical, Inc., Bedford, MA (US)

( * ) Notice: Subject to any disclaimer, the term of this patent is extended or adjusted under 35 U.S.C. 154(b) by 1528 days.

(21) Appl. No.: 13/922,640

(22) Filed: Jun. 20, 2013

(65) Prior Publication Data

US 2014/0041375 A1 Feb. 13, 2014

Related U.S. Application Data

(60) Provisional application No. 61/681,706, filed on Aug. 10, 2012.

(51) Int. Cl.
*F15B 15/00* (2006.01)
*B05C 17/015* (2006.01)

(52) U.S. Cl.
CPC ..... *F15B 15/00* (2013.01); *B05C 17/015* (2013.01)

(58) Field of Classification Search
CPC ..... B05C 17/015; B05C 17/00573; B05C 17/00596; F15B 11/0406; F15B 11/06; F15B 15/1404; F15B 15/17; F15B 2211/7054; F15B 2211/755
USPC ..... 222/61, 326
See application file for complete search history.

(56) References Cited

U.S. PATENT DOCUMENTS 3,214,102 A 10/1965 Meyer
3,768,472 A * 10/1973 Hodosh ..... A61M 5/20 222/334
3,828,980 A 8/1974 Creighton et al.
3,980,209 A * 9/1976 Collar ..... B05C 17/015 222/323
4,040,420 A 8/1977 Speer
4,359,049 A 11/1982 Redl et al.
(Continued)

FOREIGN PATENT DOCUMENTS

EP 1 955 660 8/2008
EP 2 111 918 10/2009
GB 2514853 A * 12/2014 ..... B05C 17/015

OTHER PUBLICATIONS

European Search Report EP 10 25 1809 dated Jul. 5, 2013.

*Primary Examiner* — Michael Leslie
*Assistant Examiner* — Matthew Wiblin
(74) *Attorney, Agent, or Firm* — Carter, DeLuca & Farrell LLP

(57) ABSTRACT

An actuator assembly is provided. The actuator assembly includes housing configured for operable engagement by a user, a trigger assembly operably supported on the housing, a gas cartridge releasably secured to the housing, a valve assembly mounted within the housing for controlling the flow of pressurized gas through the housing and a cylinder actuator operably operably connected to the valve assembly. The cylinder actuator includes a piston selectively extendable therefrom configured for depressing a plunger. The piston includes a head having an inlet surface disposed within an inlet chamber of the cylinder actuator and an outlet surface disposed within the outlet chamber of the cylinder actuator. The exposed surface area of the first surface is equal to the exposed surface of the second surface.

10 Claims, 7 Drawing Sheets

(56) References Cited

U.S. PATENT DOCUMENTS 4,538,920 A 9/1985 Drake
4,631,055 A 12/1986 Redl et al.
4,735,616 A 4/1988 Eibl et al.
4,753,536 A 6/1988 Spehar et al.
4,767,026 A 8/1988 Keller et al.
4,767,416 A 8/1988 Wolf et al.
4,842,581 A 6/1989 Davis
4,872,368 A 10/1989 Miller et al.
4,978,336 A 12/1990 Capozzi et al.
4,979,942 A 12/1990 Wolf et al.
5,049,135 A 9/1991 Davis
5,104,375 A 4/1992 Wolf et al.
5,116,315 A 5/1992 Capozzi et al.
5,249,709 A 10/1993 Duckworth et al.
5,249,862 A 10/1993 Herold et al.
5,328,462 A 7/1994 Fischer
5,333,760 A 8/1994 Simmen
5,383,851 A * 1/1995 McKinnon, Jr. ..... A61M 5/30 604/143
5,413,253 A 5/1995 Simmen
5,445,614 A 8/1995 Haber et al.
5,474,540 A 12/1995 Miller et al.
5,542,336 A * 8/1996 Larkin ..... F15B 9/03 91/166
5,605,255 A 2/1997 Reidel et al.
5,643,206 A 7/1997 Fischer
5,665,066 A 9/1997 Fischer
5,740,965 A 4/1998 Miyagi et al.
5,810,885 A 9/1998 Zinger
5,819,988 A 10/1998 Sawhney et al.
5,890,655 A 4/1999 Collias et al.
RE36,235 E 6/1999 Keller et al.
5,941,462 A 8/1999 Sandor
6,047,861 A 4/2000 Vidal et al.
6,065,645 A 5/2000 Sawhney et al.
6,123,396 A 10/2000 Antanavich et al.
6,161,730 A 12/2000 Heusser et al.
6,328,229 B1 12/2001 Duronio et al.
6,398,761 B1 6/2002 Bills et al.
6,425,897 B2 * 7/2002 Overes ..... A61B 17/8822 606/92
6,527,749 B1 3/2003 Roby et al.
6,585,696 B2 7/2003 Petersen et al.
6,609,666 B1 8/2003 Blake
6,648,852 B2 11/2003 Wirt et al.
6,698,622 B2 3/2004 Sawhney et al.
6,752,292 B2 6/2004 Van Herpen
6,769,574 B1 8/2004 Keller
6,773,414 B2 8/2004 Ljungquist
6,783,514 B2 8/2004 Tovey et al.
6,820,766 B2 11/2004 Keller et al.
6,835,186 B1 12/2004 Pennington et al.
6,852,099 B2 2/2005 Redl et al.
6,884,232 B1 4/2005 Hagmann et al.
6,921,381 B2 7/2005 Spero et al.
6,994,686 B2 2/2006 Cruise et al.
7,124,574 B2 10/2006 Horn et al.
7,124,914 B2 10/2006 Foster et al.
7,128,278 B2 10/2006 Archambeau et al.
7,131,597 B2 11/2006 Scattergood
7,140,558 B2 11/2006 McCracken et al.
7,140,560 B2 11/2006 Stotts et al.
7,140,797 B2 11/2006 Hunter et al.
7,152,396 B2 12/2006 Cheng
7,152,813 B2 12/2006 Chen
7,156,835 B2 1/2007 Epstein
7,159,796 B2 1/2007 Yquel
7,164,133 B2 * 1/2007 Hjertman ..... A61M 5/145 250/271
7,173,733 B2 2/2007 Gauthier et al.
7,178,742 B2 2/2007 Mellentine et al.
7,178,743 B2 2/2007 Clarke, III et al.
7,178,744 B2 2/2007 Tapphorn et al.
7,182,279 B2 2/2007 Wang
7,185,829 B2 3/2007 Sundholm
7,191,917 B2 3/2007 Brinz et al.
7,191,959 B2 3/2007 Kutay et al.
7,195,135 B1 3/2007 Garcia et al.
7,195,180 B2 3/2007 Lee
7,201,336 B2 4/2007 Blette et al.
7,207,969 B2 4/2007 Epstein et al.
7,217,254 B2 5/2007 Kirwan et al.
7,222,752 B2 5/2007 Ponton
7,223,426 B2 5/2007 Cheng et al.
7,225,999 B2 6/2007 Foianini et al.
7,232,080 B2 6/2007 Kutay et al.
7,232,082 B2 6/2007 Muhlhausen et al.
7,237,693 B2 7/2007 Brennan et al.
7,237,726 B2 7/2007 Yu
7,244,248 B2 7/2007 Azzolini
7,246,758 B2 7/2007 Wang
7,252,243 B2 8/2007 Bjorn et al.
7,252,247 B2 8/2007 Holm et al.
7,264,179 B2 9/2007 Robbins
7,267,288 B2 9/2007 Wheeler, Jr. et al.
7,270,654 B2 9/2007 Griego et al.
7,275,699 B2 10/2007 Schmidt
7,278,985 B2 10/2007 Agerup
7,611,494 B2 11/2009 Campbell et al.
7,811,291 B2 10/2010 Liu et al.
7,833,216 B2 11/2010 Voegele et al.
8,002,753 B2 * 8/2011 Krumme ..... A61M 5/14526 604/141
8,033,483 B2 * 10/2011 Fortier ..... A61B 17/00491 222/137
2002/0104851 A1 8/2002 Parise
2002/0156435 A1 10/2002 Emmons
2002/0165483 A1 11/2002 Miller et al.
2003/0062426 A1 4/2003 Gregory et al.
2003/0183653 A1 10/2003 Bills
2003/0209612 A1 11/2003 Hahnen
2005/0132877 A1 * 6/2005 Hart ..... B64C 13/42 91/509
2008/0210708 A1 * 9/2008 Yeames ..... B05C 17/015 222/61
2012/0000935 A1 * 1/2012 Brunk ..... B05B 7/061 222/137

* cited by examiner

PNEUMATIC ACTUATION ASSEMBLY

CROSS-REFERENCE TO RELATED APPLICATIONS

This application claims the benefit of and priority to U.S. Provisional Patent Application No. 61/681,706, filed Aug. 10, 2012, the entire disclosure of which is incorporated by reference herein.

BACKGROUND

Technical Field

The present disclosure relates to applicator assemblies for mixing and dispensing components. More particularly, the present disclosure relates to pneumatic actuator assemblies for controlling the flow of the components through and from the applicator assembly.

Background of Related Art

Applicator assemblies for mixing and dispensing components are known. Many of these applicator assemblies include component filled syringes for supplying the components to a mixing assembly. One such applicator assembly is disclosed in commonly own U.S. Pat. No. 8,033,483, the content of which is incorporated herein by reference in its entirety. In use, a clinician manually depresses the plungers of the syringes to supply the components to the mixing assembly. When the syringes are manually actuated, the rate at which the mixed components flow through and from the applicator assembly tends to vary. Since many mixing assemblies require a specific rate to operate effectively, the inconsistent flow rate can be problematic.

To provide a more consistent flow of components through the applicator and to a surgical site, a surgeon may attach the applicator assembly to a powered actuator assembly configured for depressing the plungers of the syringes in a consistent and controlled manner. Some of these actuator assemblies are pneumatically-powered, such that when the assembly is actuated, e.g., a trigger is squeezed, compressed fluid, typically air from a gas cartridge, is supplied to a pneumatic cylinder actuator to cause a piston within the actuator to advance, thereby depressing the plungers of syringes in a consistent and controlled manner.

Although pneumatically powered actuator assemblies are know, these assemblies experience a phenomenon known as "coasting." As will be discussed in greater detail below, the result of coasting is a continued flow of material from the applicator assembly after the actuator assembly has been deactivated, i.e., upon release of the trigger. Coasting may result in gooping, dribbling or other unwanted flow of the mixed components. As will also be discussed in greater detail below, coasting also prevents defined stops or boundaries when applying the mixed components.

Therefore, it would be beneficial to have an actuator assembly in which coasting is greatly reduced or eliminated altogether.

SUMMARY

Accordingly, an actuator assembly is provided. The actuator assembly includes a housing configured for operable engagement by a user, a trigger assembly operably supported on the housing, a gas cartridge releasably secured to the housing, a valve housing mounted within the housing for controlling the flow of pressurized gas through the housing, and a cylinder actuator including a piston selectively extendable therefrom configured for depressing a plunger. The piston includes a head having an inlet surface disposed within an inlet chamber of the cylinder actuator and an outlet surface disposed within the outlet chamber of the cylinder actuator. The exposed surface area of the first surface is equal to the exposed surface of the second surface.

In some embodiments, the piston includes a first shaft extending from the inlet surface of the head and a second shaft extending from the outlet surface of the head. The piston may include a shaft extending through the head such that the shaft extends from both the inlet and outlet surfaces of the head. Alternatively, the cylinder actuator includes first and second sections and the piston includes a first head disposed within the first section and a second head disposed within the second section. A first shaft extends between the first and second heads and second shaft extends from the second head, wherein an exposed surface area of the first head is equal to an exposed surface area of the second head. The housing may be configured for operable connection with an applicator assembly. The valve housing may include at least a first actuator valve and at least a first dispense on/off valve. The valve housing may further include at least one solenoid valve. In some embodiments, the housing includes a pencil grip. Alternatively, the housing may include a pistol grip.

Also provided is a system including an applicator assembly and an actuator assembly. The applicator assembly includes at least one syringe having a plunger. The actuator assembly is configured for operable connection to the applicator assembly. The actuator assembly includes a cylinder actuator including a piston selectively extendable therefrom for depressing the plunger. The piston includes a head having an inlet surface disposed within an inlet chamber of the cylinder actuator and an outlet surface disposed within the outlet chamber of the cylinder actuator. The exposed surface area of the first surface and the second surface are equal.

BRIEF DESCRIPTION OF THE DRAWINGS

The accompanying drawings, which are incorporated in and constitute a part of this specification, illustrate embodiments of the disclosure and, together with a general description of the disclosure given above, and the detailed description of the embodiments given below, serve to explain the principles of the disclosure, wherein.

DETAILED DESCRIPTION

Figure 1:
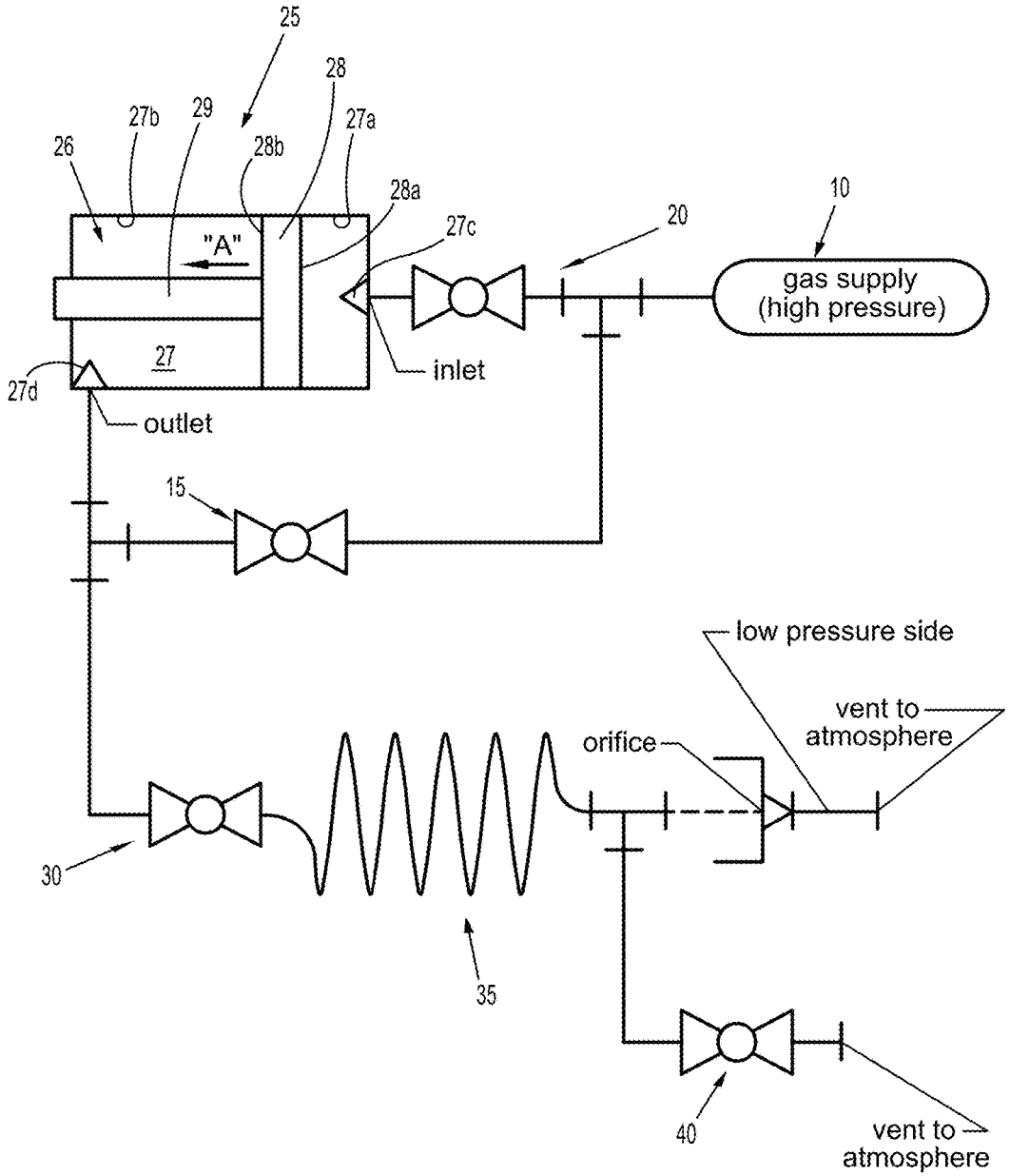
FIG. 1 is a schematic diagram of an embodiment of an actuator assembly according to the present disclosure.

Embodiments of the presently disclosed applicator assembly will now be described in detail with reference to the drawings in which like reference numerals designate identical or corresponding elements in each of the several views.

As discussed above, prior art pneumatically-powered actuator assemblies for use with applicator assemblies experience a phenomenon known as coasting. As will be discussed in further detail below, it has been determined that coasting occurs as a result of the reduced stopping force caused by the configuration of the piston head of the cylinder actuator.

Figure 7:
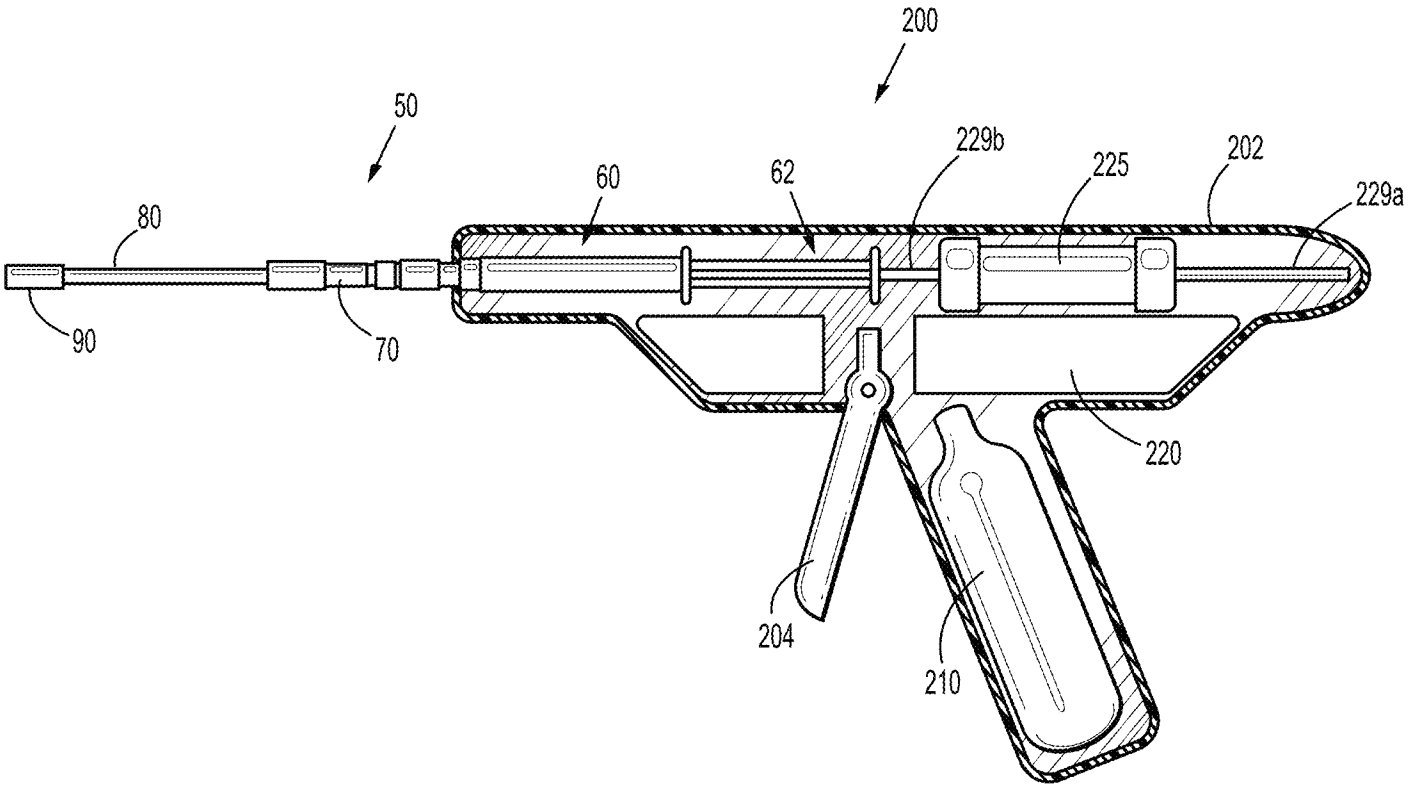
FIG. 7 is a side view an actuator assembly according to another embodiment of the present disclosure schematically illustrating the components therein and including an applicator assembly operably attached thereto.

With reference to FIG. 1, a schematic diagram of a pneumatic actuator assembly according to a first embodiment of the present disclosure is shown generally as actuator assembly 1. Actuator assembly 1 includes a gas supply 10, a primary actuator charge valve 15, a secondary actuator charge valve 20, a single-ended actuator cylinder 25, a dispense on/off valve 30, an accumulator 35 and a solenoid valve 40. Single-ended actuator cylinder 25 is configured to depress a plunger 62 (FIG. 7) of an applicator assembly 50 (FIG. 7). Actuator cylinder 25 includes a piston 26 having a head 28 and a shaft 29. Actuator cylinder 25 defines a cavity 27. Head 28 of piston 26 divides cavity 27 of actuator cylinder 25 into an inlet chamber 27*a* and an outlet chamber 27*b*. Inlet chamber 27*a* includes an inlet 27*c* and outlet chamber 27*b* includes an outlet 27*d*. Head 28 of piston 26 includes an inlet surface 28*a* disposed within inlet chamber 27*a* and an outlet surface 28*b* disposed within outlet chamber 27*b*.

The operation of actuator assembly 1 will now be described with reference to FIG. 1. Prior to use, gas supply 10 is loaded into actuator assembly 1, if not already done so, and gas supply 10 is opened, i.e., a seal is punctured. Actuator cylinder 25 is then charged by opening primary actuator charge valve 15. Once actuator cylinder 25 is fully charged, primary actuator charge valve 15 is closed. Secondary actuator charge valve 20 remains open after charging. When fully charged, the pressure within each of inlet and outlet chambers 27*a*, 27*b* of actuator cylinder 25 are equal, as are the forces acting on head 28 of piston 26, therefore piston 26 is stationary.

To actuate single-ended actuator cylinder 25, dispense on/off valve 30 is opened, i.e., a trigger is squeezed. Opening of dispense on/off valve 30 permits pressurized gas to flow from outlet 27*d* in outlet chamber 27*b* of actuator cylinder 25 and pressurized gas to flow through inlet 27*c* of inlet chamber 27*a* of actuator cylinder 25 into inlet chamber 27*a*. As the pressurized air flows from outlet chamber 27*b* and into inlet chamber 27*a*, the difference in pressure acting on head 28 of piston 26 causes piston 26 to advance distally, in the direction of arrow "A". Once dispense on/off valve 30 is closed, pressurized gas no longer flows from outlet chamber 27*b* through outlet 27*d*, and the pressure within outlet chamber 27*b* and the pressure within inlet chamber 27*a* equalize to prevent further advancement of piston 26. In this manner, piston 26 no longer depresses plunger 62 (FIG. 7) of applicator assembly 50 (FIG. 7), thereby stopping the flow of mixed components from the applicator assembly.

Figure 2:
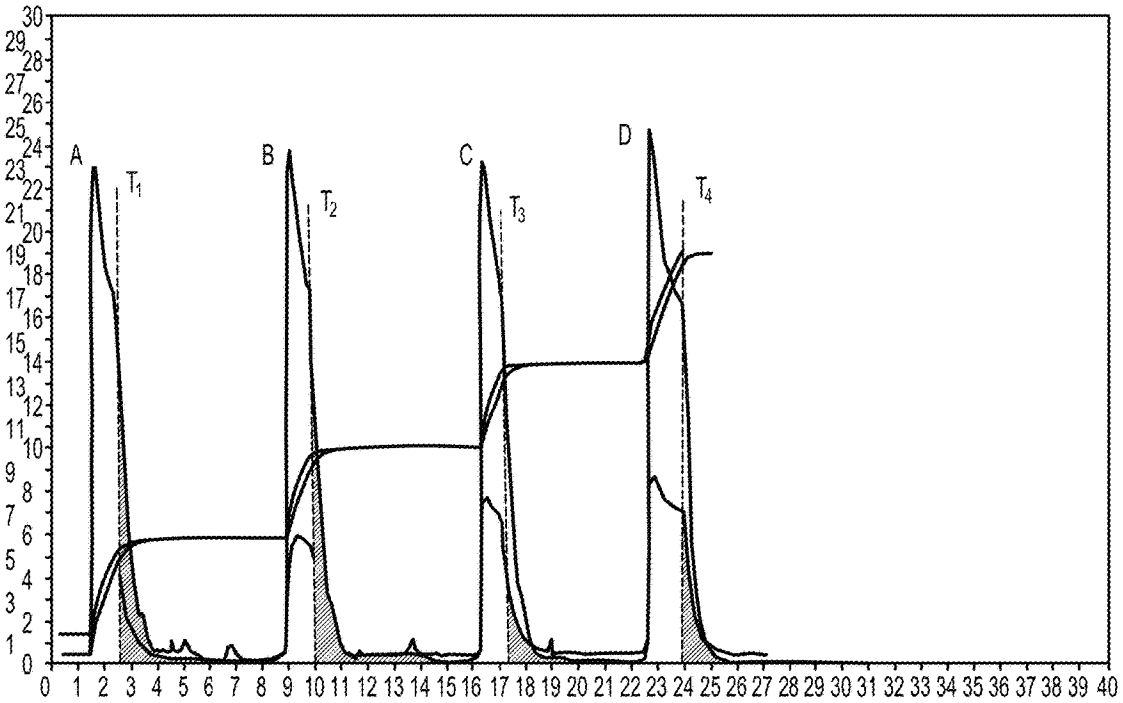
FIG. 2 is a graph showing the flow rate of mixed components exiting an applicator assembly that is actuated by the actuator assembly schematically illustrated in of FIG. 1.

With reference to the graph of FIG. 2, tests were conducted to measure the rate of the mixed components flowing from an applicator assembly while using actuator assembly 1. During the test, actuator assembly 1 was actuated (started and stopped) four times (A, B, C, D). As seen in the graph of FIG. 2, the start of each actuation is represented by a substantially vertical line, which represents the nearly instantaneous flow of mixed components from the applicator assembly upon actuation of actuator assembly 1. First actuation (A) was stopped at a time $T_1$, second actuation (B) was stopped at a time $T_2$, third actuation (C) was stopped at a time $T_3$, and fourth actuation (D) was stopped at a time $T_4$. As can be seen in the graph, the time at which the mixed components ceased flowing, i.e., attained a flow rate of zero (0), lags from the time each actuation was stopped. The amount of mixed component that is dispensed after actuator assembly 1 is stopped is indicated by the shaded areas of the graph and is a result of the coasting that occurs within single-ended actuator cylinder 25.

Figure 3:
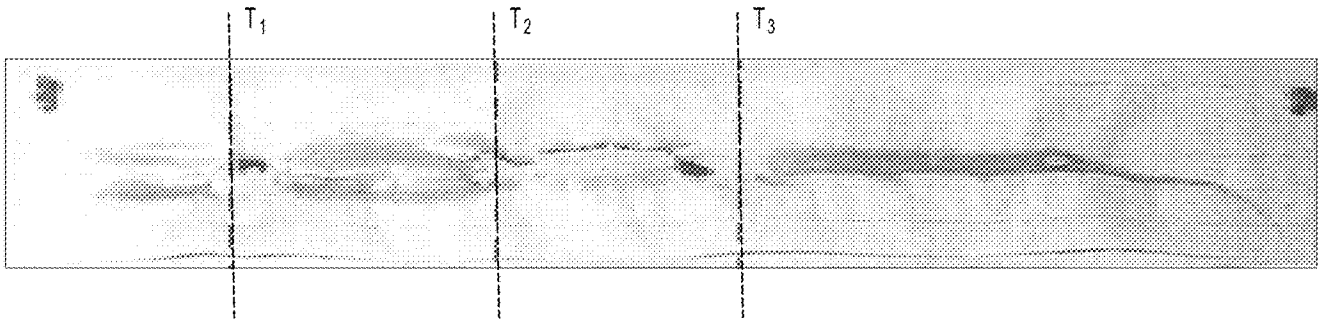
FIG. 3 is top view of a splatter sheet resulting from the flow of mixed components from the applicator assembly illustrated in the graph of FIG. 2.

A spray sheet created during the testing of actuator assembly 1 is shown in FIG. 3. As can be seen, there is no distinct boundary at the stop of each actuation. Instead, after each stoppage, mixed component continued to flow from the applicator assembly. As discussed above, this overflow may result in gooping and/or dribbling of the mixed component, thereby increasing the difficulty of performing a clean application of the mixed components.

Following testing, it was determined that the coasting in actuator assembly 1 occurs as a result of the reduced stopping force provided by outlet surface 28*b* of piston head 28. Specifically, the exposed surface area of outlet surface 28*b*, i.e., the area of piston head 28 disposed within outlet cavity 28*b*, is less then the exposed surface area of inlet surface 28*a*, i.e., the area of piston head 28 disposed within inlet cavity 28*a*. As seen in FIG. 1, the difference in exposed surface areas is caused by the surface area of distal surface 28*b* that is covered by shaft 29. The difference in exposed surface area of inlet and outlet surfaces 28*a*, 28*b* of head 28 of piston 26 results in there being less stopping force against outlet surface 28*b* subsequent to the closing of dispense on/off valve 30. The time it takes for forces acting on inlet surface 28*a* and outlet surface 28*b* of piston head 28 to equalize is the lag time, or length of time mixed components continue to flow from the applicator assembly.

Further testing found that by increasing the size of piston head 28 in relation to the diameter of shaft 29, the effect of coasting could be greatly reduced. It was also determined that although included, there was not a need for accumulator 35 on the first actuation of actuator assembly 1, as applicator assembly 50 (FIG. 7) had not yet been used, and actuator assembly 1 could operate effectively without accumulator 35 in the subsequent actuations despite the any obstructions caused by previous use. In use, accumulator 35 provides actuator assembly 1 with an initial burst of speed during actuation.

Figure 4:
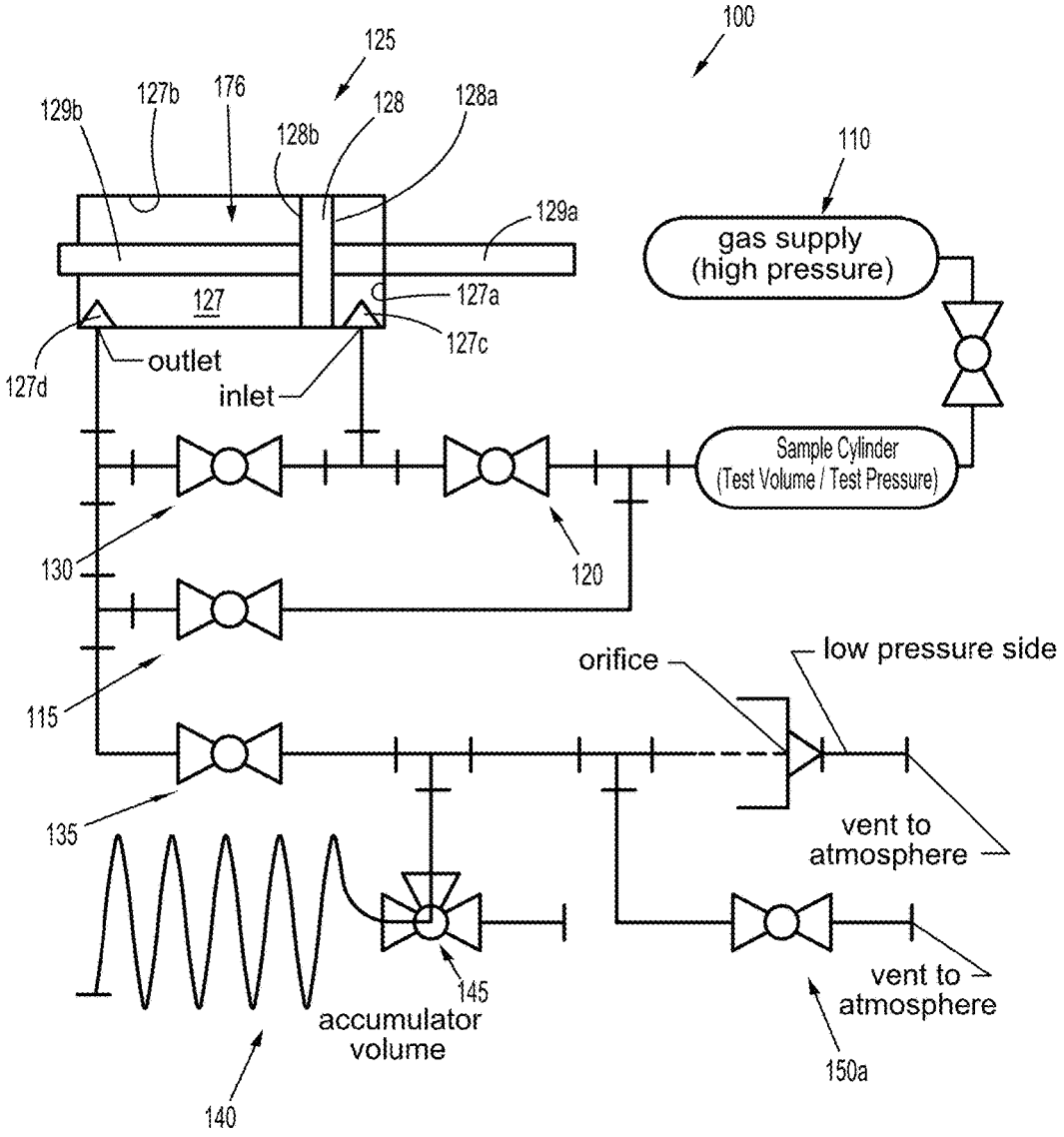
FIG. 4 is a schematic diagram of an actuator assembly according to another embodiment of the present disclosure.

With reference now to FIG. 4, a schematic of an actuator assembly according to another embodiment of the present disclosure is shown generally as actuator assembly 100. Actuator assembly 100 includes a gas supply 110, a primary actuator charge valve 115, a secondary actuator charge valve 120, a double-ended actuator cylinder 125, a first solenoid valve 130 and a dispense on/off valve 135, and may optionally include an accumulator 140, an accumulator on/off valve 145 and a solenoid valve 150*a*. Actuator assembly 100 is substantially similar to actuator assembly 1 and, therefore, will only be described as relates to the difference therebetween. Actuator assembly 100 includes a doubled-ended actuator cylinder 125 having a piston 126 including a head 128, a first shaft 129*a* extending from an inlet surface 128*a* of head 128 and a second shaft 129*b* extending from an outlet surface 128*b* of head 128.

During operation of actuator assembly 100, i.e., opening of dispense on/off valve 135, piston 126 is moved distally within cavity 127 of actuator cylinder 125 due to the flow of pressurized gas into inlet chamber 127*a* and out of outlet chamber 127*b*. Upon closing of dispense on/off valve 135, the flow of pressurized gas into inlet chamber 127*a* and out of outlet chamber 127*b* is stopped. Because each of inlet and outlet surfaces 128*a*, 128*b* of head 128 include shaft 129*a*, 129*b*, respectively, extending therefrom, the exposed surface areas of each of inlet and outlet surfaces 128*a*, 128*b* of head 128 are the same. As a result, the stopping force of outlet surface 128*b* is equal to the driving force against inlet surface 128*a*, thereby ceasing the advancement of piston head 128 immediately or almost immediately upon closing of dispense on/off valve 135. The equalization of the pressure within inlet and outlet chambers 127*a*, 127*b* may be further facilitated by solenoid valve 130 which is disposed between inlet 127*c* and outlet 127*d* of cylinder actuator 100 and is opened as dispense on/off valve 135 is closed.

Figure 5:
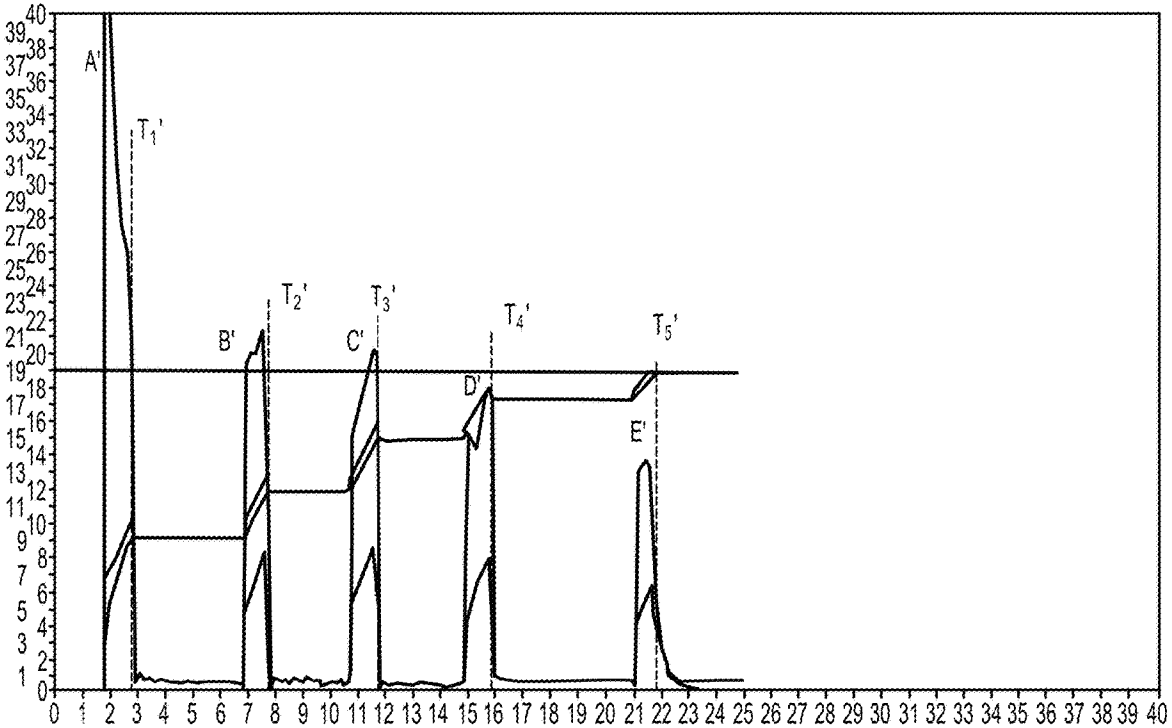
FIG. 5 is a graph showing the flow rate of mixed components exiting an applicator assembly that is actuated by the actuator assembly schematically illustrated in FIG. 4.

With reference to the graph in FIG. 5, tests similar to those discussed above with regards to actuator assembly 1 were conducted to measure the rate of the mixed components flowing from a similar applicator assembly while using actuator assembly 100. During the tests, actuator assembly 100 was actuated (started and stopped) five times (A', B', C', D', E'). Similar to the graph of FIG. 2, the start of each actuation is represented by a substantially vertical line which represents the nearly instantaneous flow of mixed components from the applicator assembly upon actuation of actuator assembly 100. First actuation (A') was stopped at a time $T_1'$, second actuation (B') was stopped at a time $T_2'$, third actuation (C') was stopped at a time $T_3'$, fourth actuation (D') was stopped at a time $T_4'$, and fifth actuation (E') was stopped at a time $T_5'$. As can be seen in the graph, the time at which the mixed components ceased flowing, i.e., attained a flow rate of zero (0), occurs almost immediately upon deactivation of actuation assembly 100. The amount of mixed component that is dispensed after actuator assembly 100, as indicated by the area between the stop time and the line representing the flow rate, is nominal.

Figure 6:
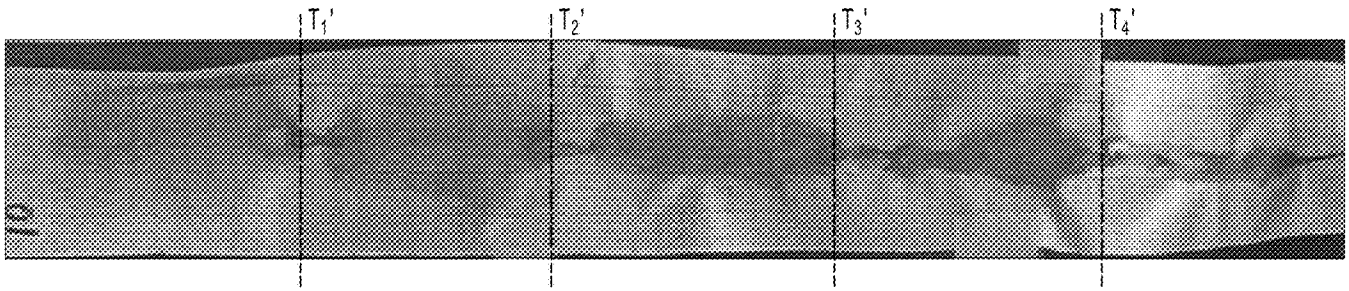
FIG. 6 is a top view of a splatter sheet resulting from the flow of mixed components from the applicator assembly illustrated in the graph of FIG. 5.

As with the previous test, a spray sheet was created during the testing of actuator assembly 100. As seen in the spray sheet shown in FIG. 6, there is a clear and distinct boundary at the stop of each actuation. As discussed above, the immediate or nearly immediate response achieved when using actuating the applicator assembly using actuation assembly 100 allows for a cleaner and more consistent application of mixed components.

As seen in the graph of FIG. 5, the flow rate of the first actuation is greater then the flow rate of the subsequent actuations. This is a result of applicator assembly 50 being unused, and therefore without any obstruction. As noted above, while included, testing showed that accumulator 135 was not necessary to the effective operation of actuator assembly 100.

With reference to FIG. 7, an embodiment of an actuator assembly according to the aspects of the present disclosure is shown generally as actuator assembly 200. Actuator assembly 200 includes a housing 202, a trigger assembly 204, a gas cartridge 210, a valve housing 220 and a double-ended cylinder actuator 225. As shown, housing 202 and trigger assembly 204 are in the form of a pistol grip. Although not shown, valve housing 220 includes one or more valves, i.e., solenoid, charge, dispense on/off, as discussed above for controlling the flow of pressurized gas through cylinder actuator 225. Housing 202 of actuator assembly 200 is configured to operably receive an applicator assembly 50. Applicator assembly 50 includes a source of components, i.e., syringes 60, a manifold 70, an elongated body 80 and a mixing/dispensing tip 90. Plunger 62 of syringes 60 are disposed adjacent to distal end of outlet shaft 229*b* of piston (not shown) of double-ended actuator 225. Syringes 60 and cylinder actuator 225 are arranged such that distal advancement of shaft 229*b* causes depression of plunger 62. Although the aspects of the present disclosure are being described for use with applicator assembly 50, it is envisioned that the aspects of the present disclosure may be modified for use with other applicator assemblies.

As discussed above, because actuator assembly 200 utilizes a doubled ended cylinder actuator 225, the surface areas of inlet and outlet surfaces (not shown) of head (not shown) of piston (not shown) are equal, therefore the equalization in pressure of inlet and outlet chambers (not shown) is nearly immediate. Thus, any coasting that was previously experienced as a result of differing exposed surface areas of the piston head is eliminated in actuator assembly 200, as the exposed surface areas of the piston head in double-ended cylinder actuator 225 are the same. Actuator assembly 200 may also include a solenoid (not shown) disposed between the inlet and the outlet to further assist in the immediate equalization of the pressure in the inlet chamber and the outlet chamber.

Figure 8:
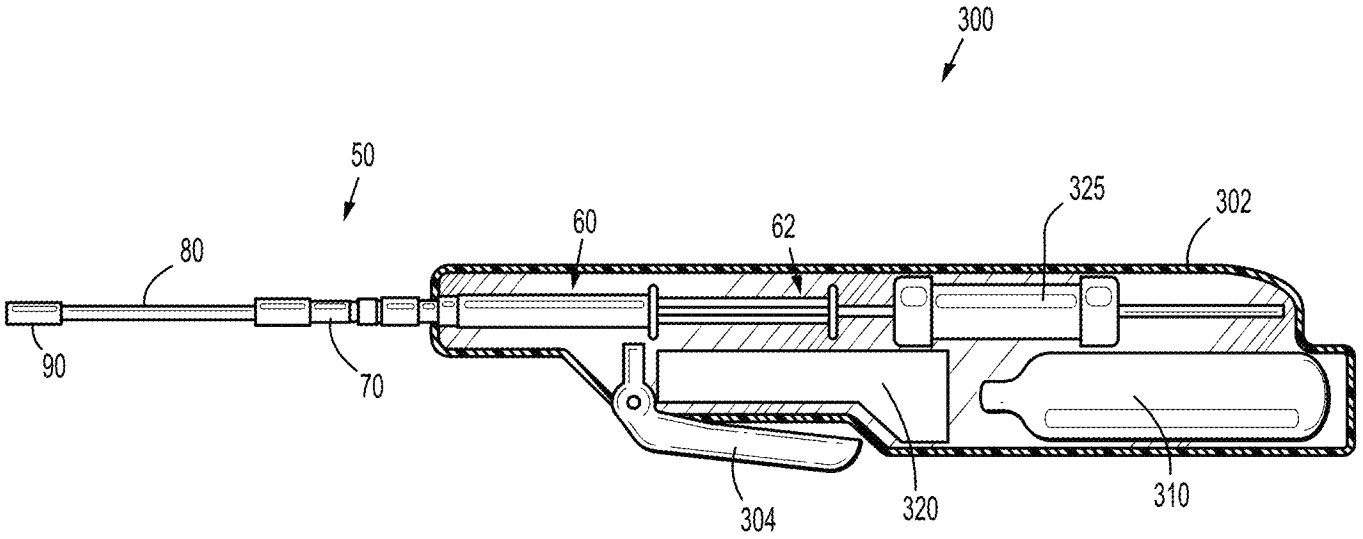
FIG. 8 is side view of an actuator assembly according to yet another embodiment of the present disclosure schematically illustrating the components therein and including an applicator assembly operably attached thereto.

Turning to FIG. 8, another embodiment of an actuator assembly according to the present disclosure is shown generally as actuator assembly 300. Actuator assembly 300 is substantially similar to actuator assembly 200 in form and function. Actuator assembly 300 includes a housing 302 and a trigger assembly 304 in the form of a pencil grip. Actuator assembly 300 further includes a gas cartridge 310, a valve housing 320 and a double-ended cylinder actuator 325. Applicator assembly 50 is operably connected to housing 302 of actuator assembly 300.

Either or both of actuator assemblies 200, 300 may include indicators (not shown) for indicating the amount of pressurized gas remaining in respective gas cartridges 210, 310, the amount of component remaining in respective syringes 60, the flow rate of the components from applicator assembly 50, and/or any other various conditions that may be monitored during the use of actuator assemblies 200, 300.

As discussed above, the coasting within actuator assembly 1 was caused by the difference in surface area between the inlet surface and the outlet surface of the head of the piston. As also discussed above, one solution to this problem was addressed by adding a shaft to the inlet surface of the piston head such that each of the inlet and outlet surfaces of the head includes shaft 129*a* (FIG. 4). Shaft 129*a* functions solely as a space holder to make equal the exposed surface areas of inlet surface 128*a* and outlet surface 128*b* of piston head 128.

Figure 9:
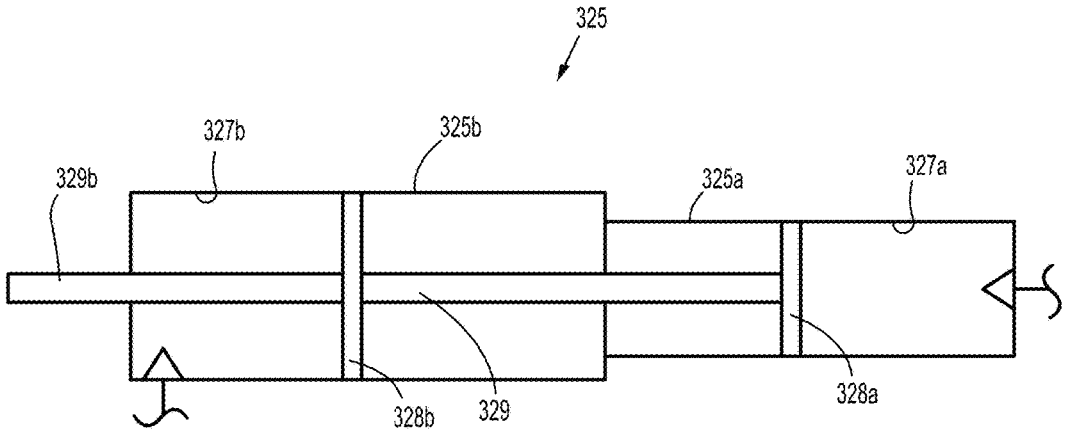
FIG. 9 is a schematic diagram of a cylinder actuator according to an embodiment of the present disclosure.

With reference to FIG. 9, an alternative means of equalizing the exposed surface areas of inlet and outlet surface of a piston head is shown. Cylinder actuator 325 includes a first section 325*a* defining an inlet chamber 327*a* and a second section 325*b* defining an outlet chamber 327*b*. A piston 328 includes a first piston head 328*a* received within inlet chamber 327*a* and a second piston head 328*b* received within outlet chamber 327*b*. First and second piston heads 328*a*, 328*b* are connected by a shaft 329. Shaft 329 may extend through second piston head 328*b*, or instead a second shaft may extend distally from second piston head 328*b*. Inlet and outlet chambers 327*a*, 327*b* and first and second piston head 328*a*, 328*b* are sized such that the surface area on the inlet side of first piston head 328*a* is equal to the exposed surface area on the outlet side of second piston head 328*b*, i.e., the surface area of second piston head 328*b* minus the surface are covered by shaft 329. In this manner, the coasting experienced in applicator assembly 50 as a result of cylinder actuator 325 during use of an actuator assembly including cylinder actuator 325 is eliminated or nearly eliminated.

Although the illustrative embodiments of the present disclosure have been described herein with reference to the accompanying drawings, it is to be understood that the disclosure is not limited to those precise embodiments, and that various other changes and modifications may be effected therein by one skilled in the art without departing from the scope or spirit of the disclosure.

What is claimed is:

1. An actuator assembly comprising:

a housing configured for operable engagement by a user;

a trigger assembly operably supported on the housing;

a gas cartridge releasably secured to the housing;

a valve housing mounted within the housing for controlling the flow of pressurized gas through the housing; and a cylinder actuator defining an inlet chamber and an outlet chamber, the cylindrical actuator including a piston selectively extendable therefrom configured for depressing a plunger, the piston including a head assembly having an inlet surface disposed within the inlet chamber of the cylinder actuator defining a first area, and an outlet surface disposed within the outlet chamber of the cylinder actuator defining a second area, wherein the first area is equal to the second area.

2. The actuator assembly of claim 1, wherein the piston includes a first shaft extending from the inlet surface of the head assembly and a second shaft extending from the outlet surface of the head.

3. The actuator assembly of claim 1, wherein the piston includes a shaft extending through the head assembly such that the shaft extends from both the inlet and outlet surfaces of the head assembly.

4. The actuator assembly of claim 1, wherein the cylinder actuator includes a first section defining the inlet chamber and a second section defining the outlet chamber, the head assembly including a first head disposed within the first section and a second head disposed within the second section, a first shaft extends between the first and second heads and a second shaft extends from the second head, wherein the first head includes the inlet surface and the second head includes the outlet surface.

5. The actuator assembly of claim 1, wherein the housing is configured for operable connection with an applicator assembly.

6. The actuator assembly of claim 1, wherein the valve housing includes at least a first actuator valve and at least a first dispense on/off valve.

7. The actuator assembly of claim 6, wherein the valve housing further includes at least one solenoid valve.

8. The actuator assembly of claim 1, wherein the housing includes a pencil grip.

9. The actuator assembly of claim 1, wherein the housing includes a pistol grip.

10. A system comprising:

an applicator assembly including at least a first syringe, wherein the at least first syringe includes a plunger; and an actuator assembly operably connected to the applicator assembly, wherein the actuator assembly includes a cylinder actuator including a piston selectively extendable therefrom for depressing the plunger, the piston including a head having an inlet surface disposed within an inlet chamber of the cylinder actuator defining a first area and an outlet surface disposed within the outlet chamber of the cylinder actuator defining a second area, wherein the first area and the second area are equal.

* * * * *